US006559742B2

(12) United States Patent
Fiedziuszko et al.

(10) Patent No.: US 6,559,742 B2
(45) Date of Patent: May 6, 2003

(54) FLEXIBLE WAVEGUIDE WITH ROUNDED CORRUGATIONS

(75) Inventors: Slawomir J. Fiedziuszko, Palo Alto, CA (US); George A. Fiedziuszko, San Jose, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 19 days.

(21) Appl. No.: 09/818,489

(22) Filed: Mar. 27, 2001

(65) Prior Publication Data

US 2003/0038691 A1 Feb. 27, 2003

(51) Int. Cl.[7] ..... H01P 3/14
(52) U.S. Cl. ..... 333/241; 333/242
(58) Field of Search ..... 333/239, 241, 333/242, 240

(56) References Cited

U.S. PATENT DOCUMENTS 4,429,290 A * 1/1984 Devan ..... 333/241
5,451,916 A * 9/1995 Kobayashi ..... 333/239
5,528,208 A * 6/1996 Kobayashi ..... 333/241

* cited by examiner

*Primary Examiner*—Michael Tokar
*Assistant Examiner*—Anh Tran
(74) *Attorney, Agent, or Firm*—Perman & Green LLP

(57) ABSTRACT

A flexible waveguide has a flexible wall enclosing an elongated cylindrical passage for transmission of an electromagnetic wave along the passage. A succession of corrugations is disposed along an interior surface of the wall facing the passage. The corrugations are spaced apart by a distance less than approximately 0.2 wavelength of the electromagnetic wave, each of the corrugations having a height greater than the distance but less than approximately 0.5 wavelength of the electromagnetic wave, and each corrugation having a curved surface to minimize loss in the transmission of the electromagnetic wave.

10 Claims, 2 Drawing Sheets

FLEXIBLE WAVEGUIDE WITH ROUNDED CORRUGATIONS

BACKGROUND OF THE INVENTION

This invention relates to a corrugated waveguide, suitable for use in a satellite communication system and, more particularly, to a form of corrugation reducing power loss associated with penetration of a waveguide wall by electromagnetic fields.

Flexible waveguides are employed for interconnecting electronic components, such as microwave components carried by a satellite in a satellite communications system. A common form of flexible waveguide has steps and/or corrugations which permit a flexing of the waveguide while facilitating its manufacture. In the usual construction of such a waveguide, ends of the waveguide are provided with flanges by which the waveguide can be secured to the electronic components which are to be interconnected. The flexibility of the waveguide permits the flanges to be moved about and oriented for attachment to the electronic components.

A desirable feature in such a waveguide is the minimization of loss of power for electromagnetic waves transmitted via the waveguide. The internal geometry of available flexible waveguides having steps and relatively sharp-cornered corrugations is not designed to be optimal from the point of view of reducing power loss. Therefore, the available flexible waveguides present the disadvantage of unnecessarily large power loss in the communication of electromagnetic waves between microwave components.

SUMMARY OF THE INVENTION

The aforementioned disadvantage is overcome and other benefits are provided by a flexible waveguide, wherein flexibility is provided by corrugations constructed in accordance with the invention with a rounded or sinuous form. The corrugations need be provided only on the inside of the waveguide. However, as a convenience in the manufacture of the waveguide of thin sheet material, the sheet material may be bent in a manner wherein the corrugations appear on both the inside and the outside of the waveguide. The distance between corrugations should be significantly less than the wavelength, preferably less than approximately 0.2 wavelength of the electromagnetic radiation carried by the waveguide. The height (or depth) of a corrugation is less than approximately 0.5 wavelength but is greater than the distance between the corrugations.

In the theory of operation of the invention, the corrugations, with the cross-sectional dimensions substantially smaller than a wavelength, may be likened to an electrically conductive wall with small holes therein. The holes have cross-sectional dimensions substantially less than a wavelength. In such an electromagnetic structure, there is little penetration of electromagnetic energy through the holes with the result that an electromagnetic wave interacting with the wall interacts with a reduced surface region of the wall. By way of example of such interaction, a component of the magnetic vector parallel to the surface of the wall may induce a surface current in the wall resulting in a power loss proportional to the product of the current and resistance of the wall. The presence of numerous small holes in the wall reduces the amount of wall surface available for interaction with the electromagnetic wave, with a consequent reduction in the amount of power loss. In similar fashion, the presence of the corrugations reduces the amount of surface current and the power loss associated therewith. Performance of the waveguide is improved by the use of the corrugations, the performance being characterized by reduced power loss and insignificant generation of higher order modes of the electromagnetic wave.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element but may not be referenced in the description for all figures.

DETAILED DESCRIPTION OF THE INVENTION

Figure 1:
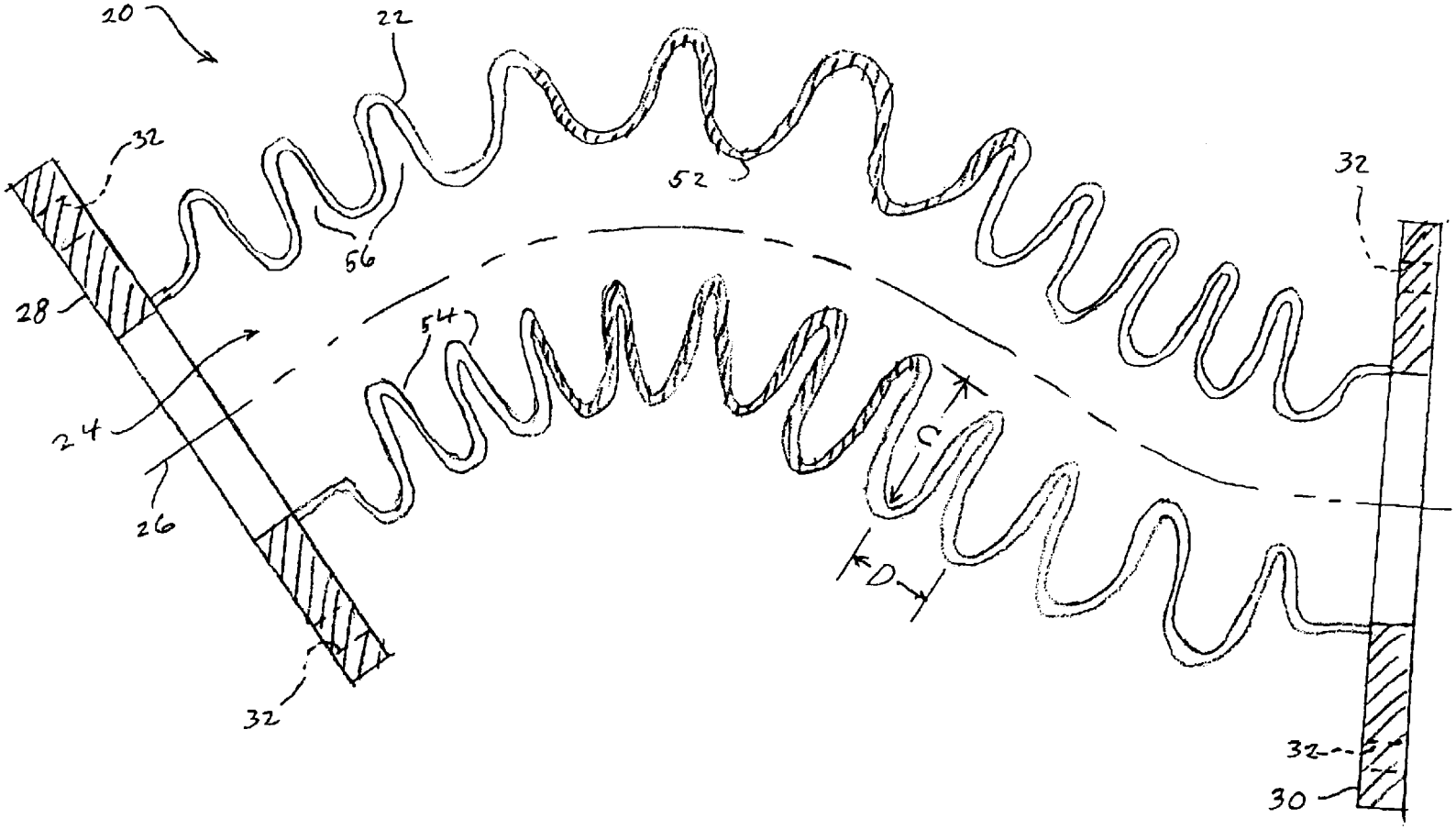
FIG. 1 is a stylized view of a flexible waveguide constructed in accordance with the invention, the view being a longitudinal section of the waveguide.

With reference to FIG. 1, a waveguide 20 is constructed of a flexible corrugated wall 22 defining an interior passage 24 through which an electromagnetic wave can propagate. In the embodiment of FIG. 1, the wall 20 is constructed of electrically conductive material, preferably a metal such as a sheet or foil of aluminum or copper. The waveguide 20 is shown in a sinuous form, to demonstrate the flexibility of the waveguide, wherein a longitudinal axis 26 of the waveguide 20 serves as a center line of the passage 24. In an unbent state of the waveguide 20, the axis 26 is straight and the waveguide 20 has a generally cylindrical form. Flanges 28 and 30 are provided at opposite ends of the waveguide 20 for connecting the waveguide 20 to microwave components, deleted in FIG. 1 to simplify the drawing. The flanges 28 and 30 are provided with bores 32 for receiving screws (not shown) which secure the flanges to the microwave components.

Figure 2:
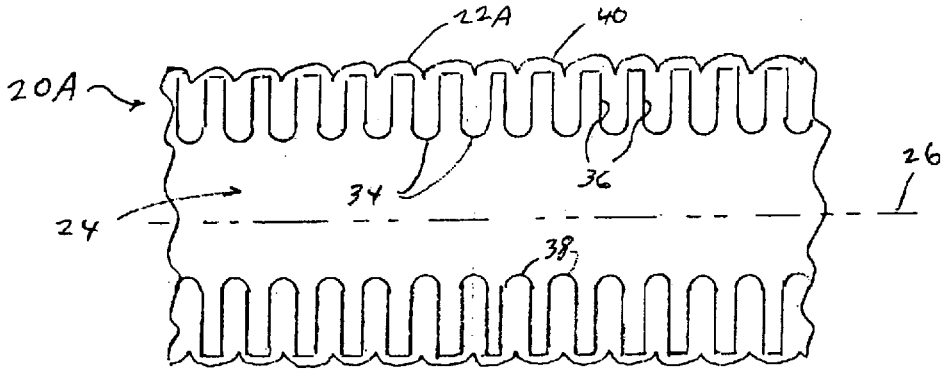
FIG. 2 is a fragmentary sectional view of an alternative embodiment of the flexible waveguide with ribs of the corrugation being formed along the interior surface of the waveguide wall while the exterior surface is relatively flat.

With reference to an alternative configuration of the waveguide wall depicted in FIG. 2, there is shown a section of waveguide 20A with a wall 22A having a modified form of corrugation characterized by interior ribs 34 spaced apart by troughs 36. The tips 38 of the ribs 34 facing the axis 24 are rounded, as by a circular arc, and the sidewalls of the troughs 36 are straight. The outer ends of the troughs 36 may be flat, in sectional view of FIG. 2, or may be provided with a curvature (not shown in FIG. 2). The exterior surface 40 of the wall 22A is generally flat, having no more than a relatively shallow ribbing which facilitates a flexing of the waveguide 20A. The internal and the external ribbing may be formed either by a process of casting, molding or machining.

Figure 3:
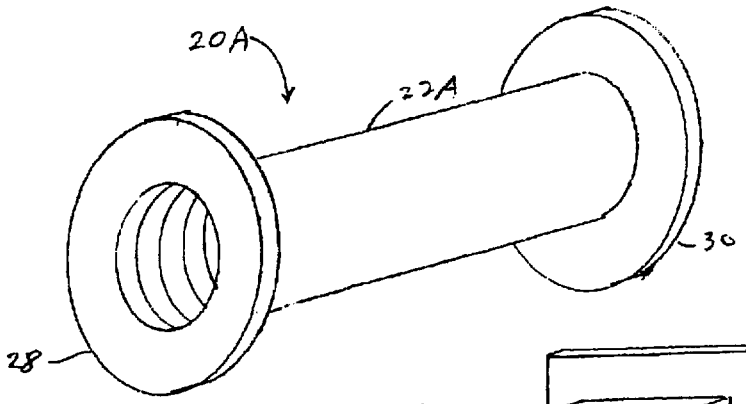
FIG. 3 is a stylized perspective view of a waveguide having a circular cylindrical form, wherein the outer surface of the waveguide wall is essentially flat while the interior surface of the wall comprises a succession of ribs.

FIG. 3 shows a perspective view of a complete section of the waveguide 20A of FIG. 2, including mounting flanges 28 and 30. Prior to a bending of the waveguide 20A, the waveguide has the configuration of a right circular cylinder. The waveguide 20 of FIG. 1 may similarly be configured as the right circular cylinder of FIG. 3, prior to a flexing of the waveguide. Alternatively, instead of being a perfectly circular cylinder, the cross section of the waveguide 20 or 20A may be elliptical, by way of example.

Figure 4:
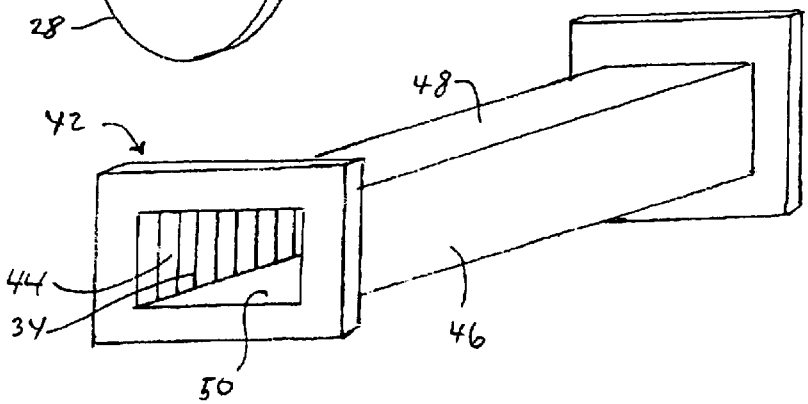
FIG. 4 is a perspective view of waveguide having a rectangular cross section, wherein the outer surface of the waveguide wall is essentially flat while the interior surface of one side of the wall comprises a succession of ribs.

FIG. 4 shows a waveguide 42 having a rectangular cross section. FIG. 4 demonstrates how the waveguide 20A of FIG. 2 may be constructed with a rectangular configuration. FIG. 4 demonstrates a further option for construction of the corrugated waveguide wherein the corrugation of the wall 22A may be provided only on two sidewalls 44 and 46 of the waveguide 42 rather than being placed on all four walls, namely, the sidewalls 44 and 46 and the broad walls 48 and 50 of the waveguide 42. Such construction may be useful wherein bending is required only about a broad wall.

Figure 6:
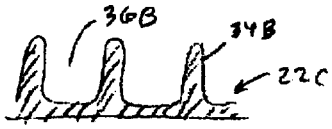
FIG. 6 is a view similar to that of FIG. 5, but showing corrugation wherein the thickness of a rib is less than the width of a trough of the corrugations of the wall.
Figure 5:
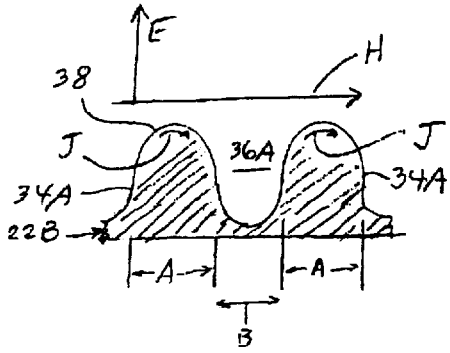
FIG. 5 is a fragmentary view of waveguide wall showing an embodiment wherein the thickness of a corrugation rib is greater than, or approximately equal to, a trough between two successive ribs of the corrugation.

FIG. 5 shows a waveguide wall 22B which is similar in construction to the waveguide wall 22A of FIG. 2, but differs therefrom in that, in the embodiment of FIG. 5, ribs 34A have curved sides rather than the straight sides depicted in FIG. 2 for the ribs 34. Similarly, the sidewall of a trough 36A of FIG. 5 is curved. FIG. 5 depicts the situation wherein the width of a rib 34A (indicated at A) is equal to or somewhat greater than the width of the trough 36A (indicated at B). A waveguide wall 22C depicted in FIG. 6 is similar in construction to the waveguide wall 22B of FIG. 5 but differs therefrom in that the width of a rib 34B (FIG. 6) of the wall 22C is less than the width of a trough 36B of the wall 22C. The configuration of waveguide wall depicted in either FIG. 5 or FIG. 6 may be employed in waveguides configured with circular or rectangular configurations such as depicted in FIGS. 3 and 4.

The nomenclature of rib and trough may be applied also to the interior surface 52 of the corrugation of the waveguide wall 22 of FIG. 1 wherein the interior surface 52 is characterized by ribs 54 spaced apart by troughs 56. The dimensions of the ribs 54 and the troughs 56 vary in FIG. 1 due to the flexing of the waveguide 20. The depth of the trough 56 (indicated at C) is greater than the spacing between ribs 54 (indicated at D). The distance D between corrugations, or ribs 54, should be significantly less than the wavelength of the electromagnetic radiation propagating along the waveguide 20, preferably less than approximately 0.2 wavelength of the electromagnetic radiation carried by the waveguide. The height (or depth) C of the trough 56 of a corrugation is less than approximately 0.5 wavelength but is greater than the distance D between the corrugations.

With respect to the theory of operation of the invention, FIG. 5 shows a graphical representation of the electromagnetic field which is shown to have an electric component (E) and a magnetic component (H), the latter being parallel to the wall 22B. There is interaction of the magnetic component (H) with the region at the tip 38 of a rib 34A to produce surface current J. The surface current is produced only at the region of the tip 38 of which the surface is substantially parallel to the direction of the H vector. There is essentially no interaction of the surface of the steep slopes of the trough 36A with the magnetic component (H). As a result of the production of the surface current, there is resistive loss associated with the flow of the electric current in the electrically conductive maternal of the ribs 34A with a corresponding loss of power from the electromagnetic wave. Since only a relatively small portion of the corrugated waveguide wall 22B interacts with the magnetic component of the electromagnetic wave, as compared to a much larger interaction region in the case of a flat waveguide wall or a corrugated wall having flat tops to the ribs, or corrugations, the flexible waveguide of the invention provides for a more efficient transfer, reduced loss, of electromagnetic power. The relatively small spacing D between the corrugations enables the electromagnetic characteristics of the corrugated wall to approach that of a flat-surface wall, thereby to preserve the mode of propagation within the waveguide.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A flexible waveguide comprising:

a wall enclosing an elongated passage for transmission of an electromagnetic wave along the passage, the wall being constructed of a flexible material allowing for displacement of a first end of the passage relative to a second end of the passage;

a succession of corrugations disposed along an interior surface of the wall facing said passage;

wherein successive ones of said corrugations are spaced apart by a distance less than approximately 0.2 wavelength of the electromagnetic wave, each of the corrugations having a height greater than said distance but less than approximately 0.5 wavelength of the electromagnetic wave, and each corrugation of the succession of corrugations having a curved surface to inhibit loss of power from the electromagnetic wave; and wherein the wall has a generally rectangular cross section in a plane normal to a central axis of the waveguide, and a thickness of a rib of the corrugation is less than a width of a trough between adjacent ribs of the corrugation.

2. A waveguide according to claim 1 wherein the wall is constructed of corrugated sheet metal.

3. A waveguide according to claim 1 wherein the corrugations disposed on the interior surface of the wall are machined grooves.

4. A waveguide according to claim 1 wherein the corrugations have uniform dimensions.

5. A waveguide according to claim 1 wherein the corrugations vary in their dimensions.

6. A waveguide according to claim 1 further comprising mounting flanges disposed on a first end of the wall at the first end of the passage and on a second end of the wall at the second end of the passage for securing each of first and second ends of the waveguide to respective electronic components.

7. A waveguide according to claim 1 wherein a portion of each corrugation nearest to a central axis of the waveguide has a generally sinusoidal shape.

8. A waveguide according to claim 1 wherein a portion of each corrugation nearest to a central axis of the waveguide has a generally circular shape.

9. A waveguide according to claim 1 wherein, in an unbent state of the waveguide, the passage has a generally cylindrical shape.

10. A waveguide according to claim 1 wherein ribs of the corrugation are located on at least one surface of the wall.

* * * * *